US011499289B2

(12) United States Patent
Tsuchihara et al.

(10) Patent No.: US 11,499,289 B2
(45) Date of Patent: Nov. 15, 2022

(54) CONSTRUCTION MACHINE EQUIPPED WITH DOZER

(71) Applicant: KOBELCO CONSTRUCTION MACHINERY CO., LTD., Hiroshima (JP)

(72) Inventors: Tatsuya Tsuchihara, Hiroshima (JP); Hiroyoshi Ishihama, Hiroshima (JP); Satoko Maeda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 212 days.

(21) Appl. No.: 16/788,404

(22) Filed: Feb. 12, 2020

(65) Prior Publication Data

US 2020/0270841 A1 Aug. 27, 2020

(30) Foreign Application Priority Data

Feb. 21, 2019 (JP) ..... JP2019-029631

(51) Int. Cl.
*E02F 3/76* (2006.01)
*E02F 3/815* (2006.01)

(52) U.S. Cl.
CPC ..... *E02F 3/7613* (2013.01); *E02F 3/7604* (2013.01); *E02F 3/8152* (2013.01)

(58) Field of Classification Search
CPC ..... E02F 3/7613; E02F 3/7604; E02F 3/8152
See application file for complete search history.

(56) References Cited

U.S. PATENT DOCUMENTS 2,718,312 A * 9/1955 Pilch ..... E02F 3/32 212/245
5,836,232 A * 11/1998 Williams ..... F15B 15/261 92/28
6,149,374 A * 11/2000 Dershem ..... E02F 9/24 212/292

(Continued)

FOREIGN PATENT DOCUMENTS

CN 103140630 A 6/2013
EP 1 482 096 A2 12/2004
WO WO 2016/108274 A1 7/2016

OTHER PUBLICATIONS

Extended European Search Report dated Apr. 29, 2020 in corresponding European Patent Application No. 20157642.8, 6 pages.

(Continued)

*Primary Examiner* — Jessica H Lutz
(74) *Attorney, Agent, or Firm* — Oblon, McClelland, Maier & Neustadt, L.L.P.

(57) ABSTRACT

Provided is a construction machine equipped with a dozer and capable of holding the dozer in an upper position. The construction machine includes a dozer cylinder that brings the dozer into rotational movement, a first cylinder pin, a first connection member joined with an end of the first cylinder pin and defining a first through-hole, a second cylinder pin, a second connection member joined with an end of the second cylinder pin and defining a second through-hole, and a fixing member to be detachably connected to the first and second connection members to interconnect them and thereby fix the dozer in the upper position.

7 Claims, 9 Drawing Sheets

(56) References Cited

U.S. PATENT DOCUMENTS

| | | | | |
|---|---|---|---|---|
| 7,174,968 | B2 * | 2/2007 | Okunishi | E02F 9/085 172/819 |
| 7,530,184 | B2 * | 5/2009 | Ishihama | E02F 3/815 172/701.3 |
| 9,243,382 | B2 * | 1/2016 | Yamazaki | E02F 5/32 |
| 9,909,279 | B2 * | 3/2018 | D'Amico | E02F 3/388 |
| 10,407,867 | B2 * | 9/2019 | Wyss | E02F 3/7618 |
| 2002/0066215 | A1 | 6/2002 | Kaczmarski et al. | |
| 2003/0226293 | A1 * | 12/2003 | Takemura | E02F 9/0841 37/466 |
| 2021/0270003 | A1 * | 9/2021 | Horii | E02F 9/2271 |
| 2022/0002981 | A1 * | 1/2022 | Bjerke | E02F 9/2833 |

OTHER PUBLICATIONS

Combined Chinese Office Action and Search Report dated Jul. 4, 2022 in Chinese Patent Application No. 202010097747.9 (with English summary), 8 pages.

* cited by examiner

CONSTRUCTION MACHINE EQUIPPED WITH DOZER

TECHNICAL FIELD

The present invention relates to a construction machine equipped with a dozer.

BACKGROUND ART

International Patent Application Publication No. 2016/108274 recites fixing a hydraulic excavator to be transported on a loading platform of, for example, a truck or a trailer, to the loading platform with a plurality of wire ropes. The plurality of wire ropes are tightened while intersecting each other between right and left crawlers of a lower travelling body of the hydraulic excavator while being.

In a hydraulic excavator whose lower travelling body includes a truck frame and a dozer disposed vertically movably on the front portion of the truck frame, the dozer would come into contact with the wire ropes, if being in a lower position. For the reason, it is required to retract a dozer cylinder connected to the dozer to locate the dozer in an upper position in order to route the wire ropes under the dozer.

However, there is a possibility of prevention of the dozer from being held in the upper position by gradual extension of the dozer cylinder due to leakage of hydraulic fluid from the dozer cylinder during the transportation of the hydraulic excavator.

SUMMARY OF INVENTION

The object of the present invention is to provide a construction machine capable of reliably holding a dozer in an upper position. Provided is a construction machine, comprising: a lower travelling body including a lower frame; a dozer capable of vertically rotational movement relative to the lower frame; at least one dozer cylinder including a cylinder tube and a piston rod capable of protruding from and retracting into the cylinder tube to bring the dozer cylinder into expansion and contraction in a cylinder axis direction, the dozer cylinder being connected to the dozer so as to bring the dozer into vertically rotational movement, through the expansion and contraction of the dozer cylinder, between an upper position and a lower position; a first cylinder pin movable integrally with a first cylinder element, which is one of the cylinder tube and the piston rod, while connecting the first cylinder element to the dozer so as to allow the first cylinder element to make rotational movement relative to the dozer; a second cylinder pin movable integrally with a second cylinder element, which is the other of the cylinder tube and the piston rod, while connecting the second cylinder element to the lower frame so as to allow the second cylinder element to make rotational movement relative to the lower frame; a first connection member joined with an end of the first cylinder pin and defining a first through-hole passing through the first connection member in a first penetration direction intersecting (preferably, perpendicularly intersecting) the cylinder axis direction; a second connection member joined with an end of the second cylinder pin and defining a second through-hole passing through the second connection member in a second penetration direction that is parallel to the first penetration direction of the first through-hole when the dozer is in the upper position; and a fixing member for interconnecting the first connection member and the second connection member to fix the dozer in the upper position. The fixing member includes a first engagement section having a first insertion part and a first support part for supporting the first insertion part, the first engagement section being capable of first engagement with the first connection member, the first engagement involving insertion of the first insertion part into the first through-hole, to be thereby detachably connected to the first connection member, a second engagement section having a second insertion part and a second support part for supporting the second insertion part, the second engagement section being capable of second engagement with the second connection member, the second engagement involving insertion of the second insertion part into the second through-hole, to be thereby detachably connected to the second connection member, and an interconnection section interconnecting the first engagement section and the second engagement section.

DESCRIPTION OF EMBODIMENTS

Below will be described an embodiment of the present invention with reference to the accompanying drawings. It should be understood that the embodiment described hereinafter is merely illustrative, and is not intended to limit the application and use of the present invention in any way.

Figure 1:
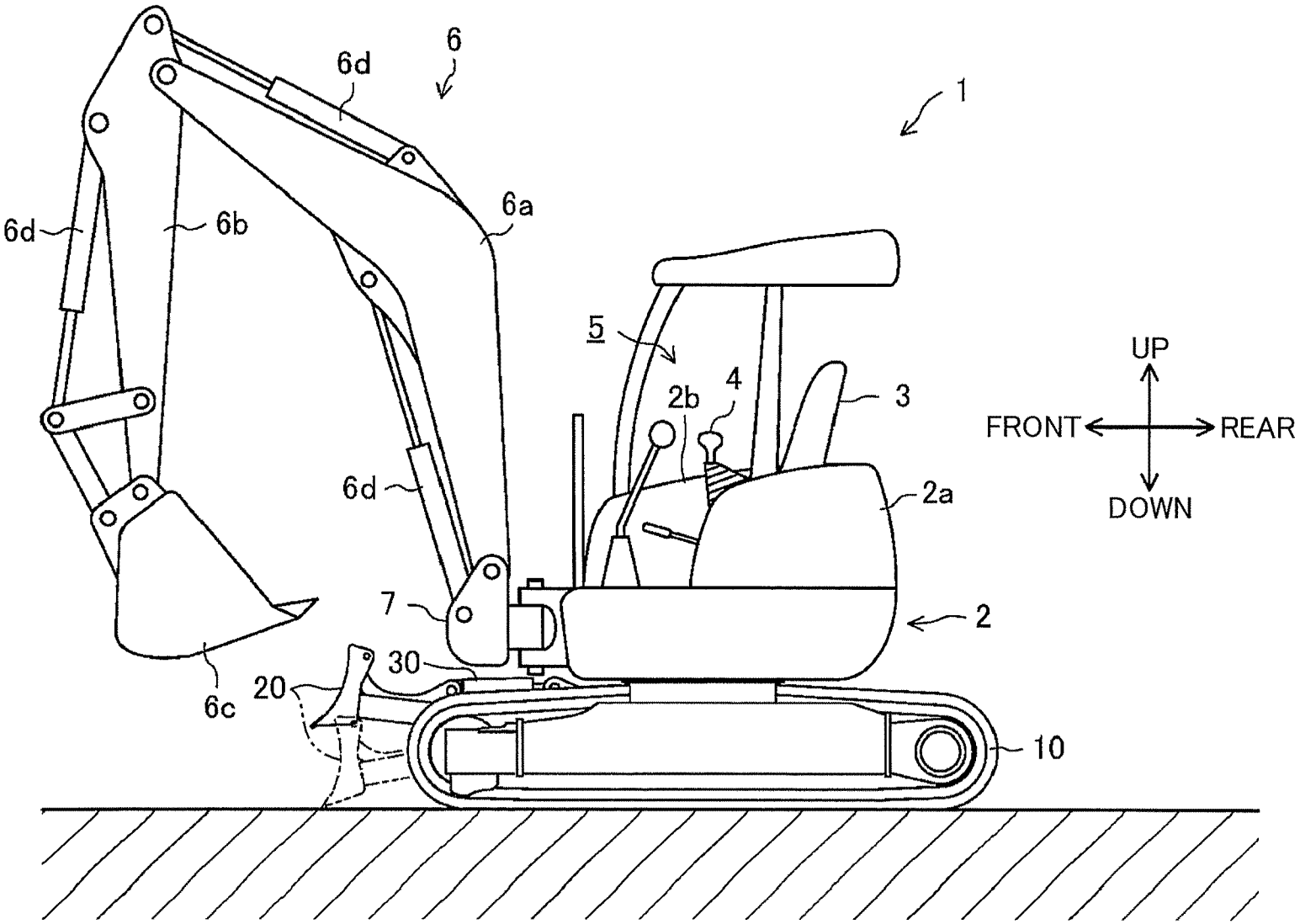
FIG. 1 is a side view of a construction machine according to an embodiment of the present invention.

FIG. 1 shows a construction machine 1 according to the embodiment. The construction machine 1 is of a rearward small-slewing-radius type, including a crawler-type lower travelling body 10, an upper slewing body 2 mounted on the lower travelling body 10 so as to be slewable, and a working device 6.

The upper slewing body 2 includes an engine cover 2*a*, a machine room cover 2*b*, and an operation space 5. The engine cover 2*a* is disposed at a rear portion of the upper slewing body 2 and covers an engine room for accommodating a not-graphically-shown engine. The machine room cover 2*b* is disposed on a right side of the upper slewing body 2 and covers a side machine room for accommodating a not-graphically-shown fuel tank and hydraulic fluid tank. The operation space 5 is defined on a left side of the upper slewing body 2 to allow a driver's seat 3 for an operator and an operator lever 4 to be manipulated by the operator to be disposed in the operation space 5.

The working device 6 is mounted on a front portion of the upper slewing body 2, being capable of making operations for excavation and the like. The working device 6 includes a boom 6*a*, an arm 6*b*, a bucket 6*c*, and a plurality of hydraulic cylinders 6*d*. The boom 6*a* has a proximal end and a distal end opposite thereto, the proximal end being attached to a middle portion of the upper slewing body 2 widthwise of the upper stewing body 2, i.e., in a direction perpendicularly intersecting the front-rear direction of the upper slewing body 2, through a swing connection member 7, so as to be capable of rotational movement. The arm 6*b* is attached to the distal end of the boom 6*a* so as to be capable of rotational movement. The bucket 6*c* is attached to the distal end of the arm 6*b* so as to be capable of rotational movement. The plurality of hydraulic cylinders 6*d* are disposed so as to cause respective operations, namely, raising and lowering (rotational movement relative to the upper slewing body 2) of the boom 6*a*, rotational movement of the arm 6*b* relative to the boom 6*a*, and rotational movement of the bucket 6*c* relative to the arm 6*b*, involved by expansion and contraction of the respective hydraulic cylinders 6*d*.

The construction machine 1 includes a dozer 20, a pair of dozer cylinders 30, two pairs of first cylinder pins 25 and second cylinder pins 35, the first cylinder pin 25 and the second cylinder pin 35 in each pair being connected to each of the pair of dozer cylinders 30, two first connection members 26 connected to the first cylinder pins 25, respectively, second connection members 36 connected to the second cylinder pins 35, respectively, and a pair of fixing members 40 provided for the pair of dozer cylinders 30, respectively.

The dozer 20 is attached to the front portion of the lower travelling body 10 so as to be capable of vertically rotational movement to be used, for example, for removing soil and leveling the ground. Each of the dozer cylinders 30 is a hydraulic cylinder capable of expanding and contracting in a cylinder axis direction, being connected to the dozer 20 and the upper slewing body 2 so as to cause the expansion and contraction of the dozer cylinders 30 to involve the vertically rotational movement of the dozer 20 relative to the upper slewing body.

Figure 2:
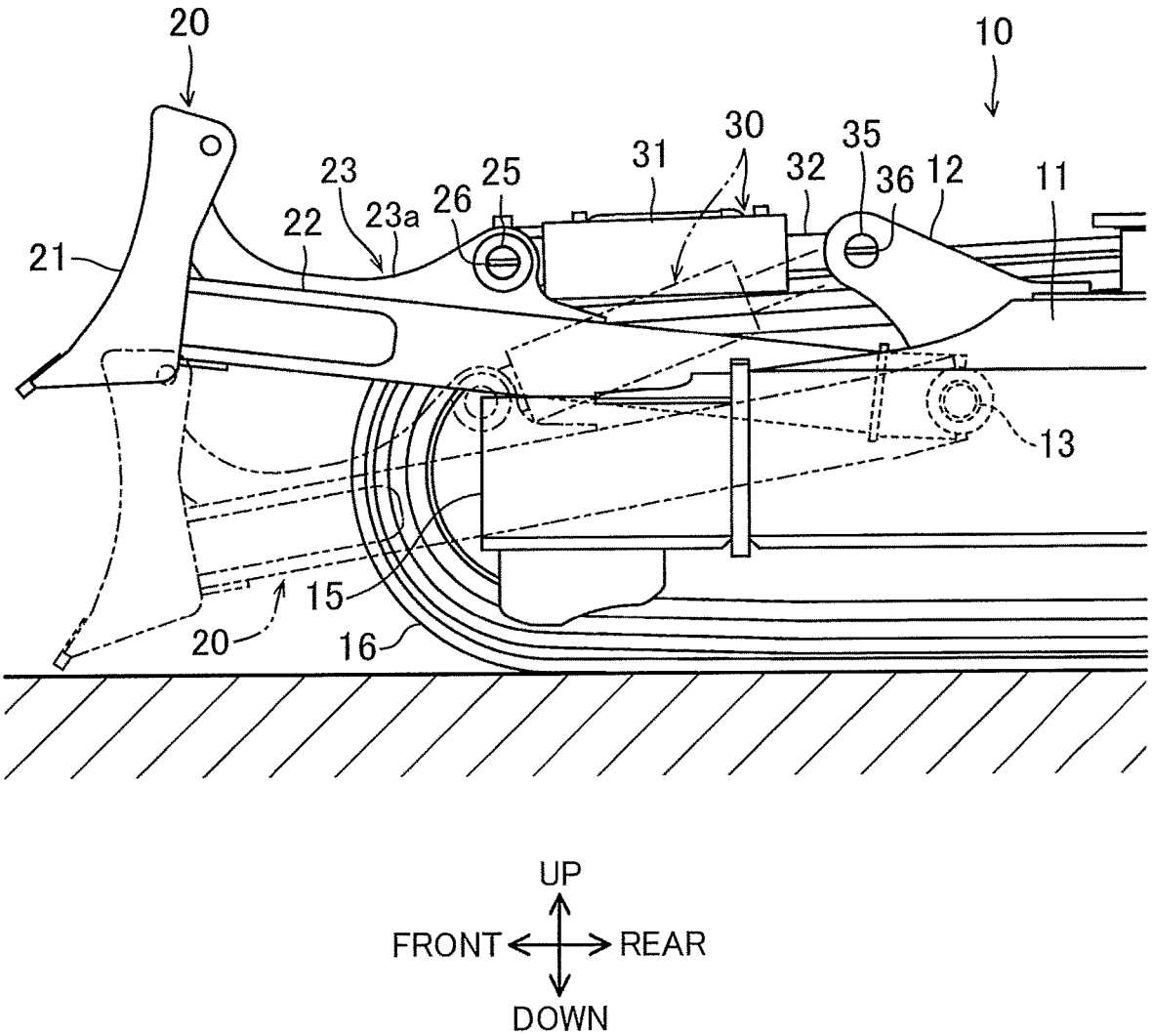
FIG. 2 is a side view showing a dozer and dozer cylinders of the construction machine.
Figure 3:
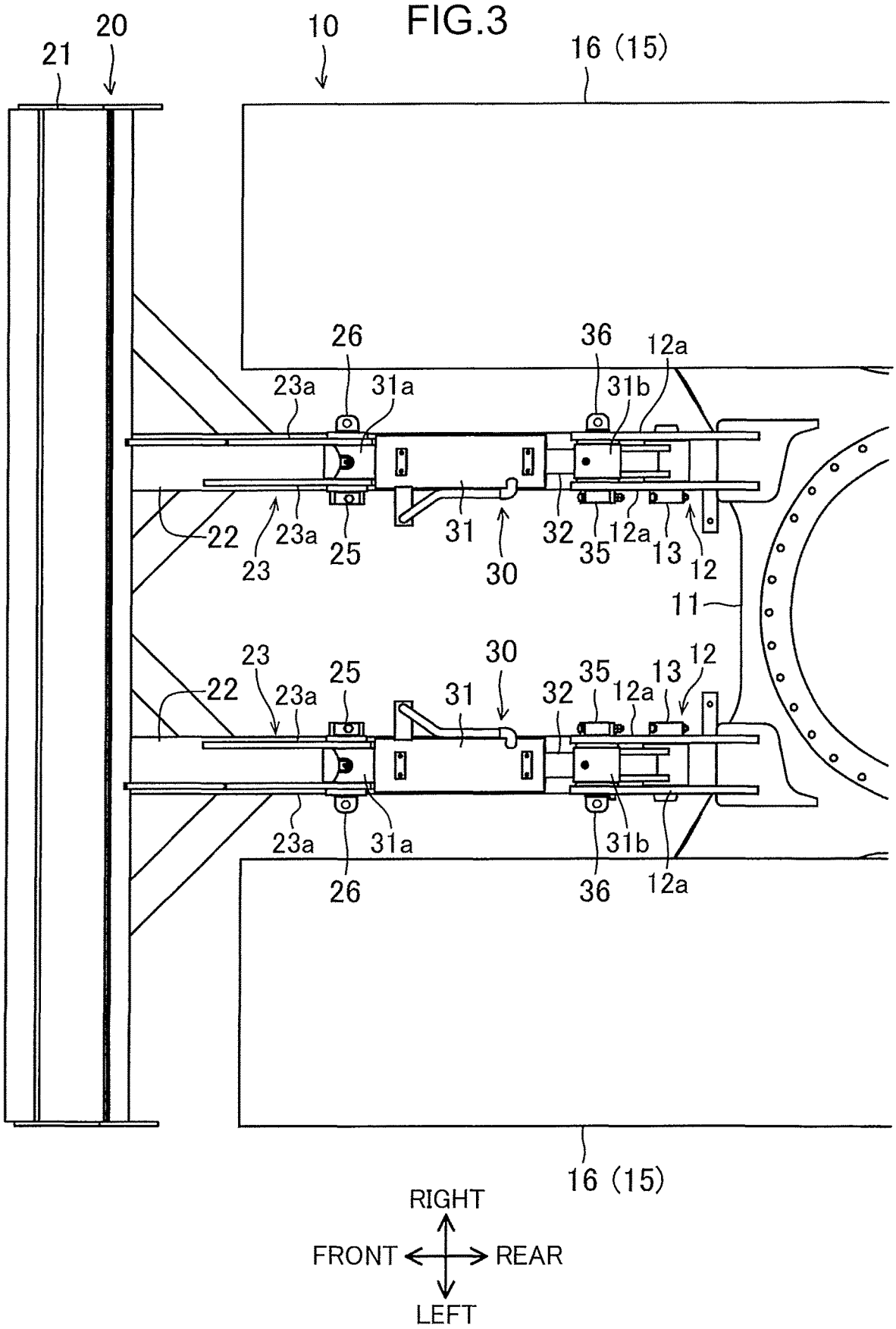
FIG. 3 is a plan view showing the dozer and the dozer cylinders.
Figure 4:
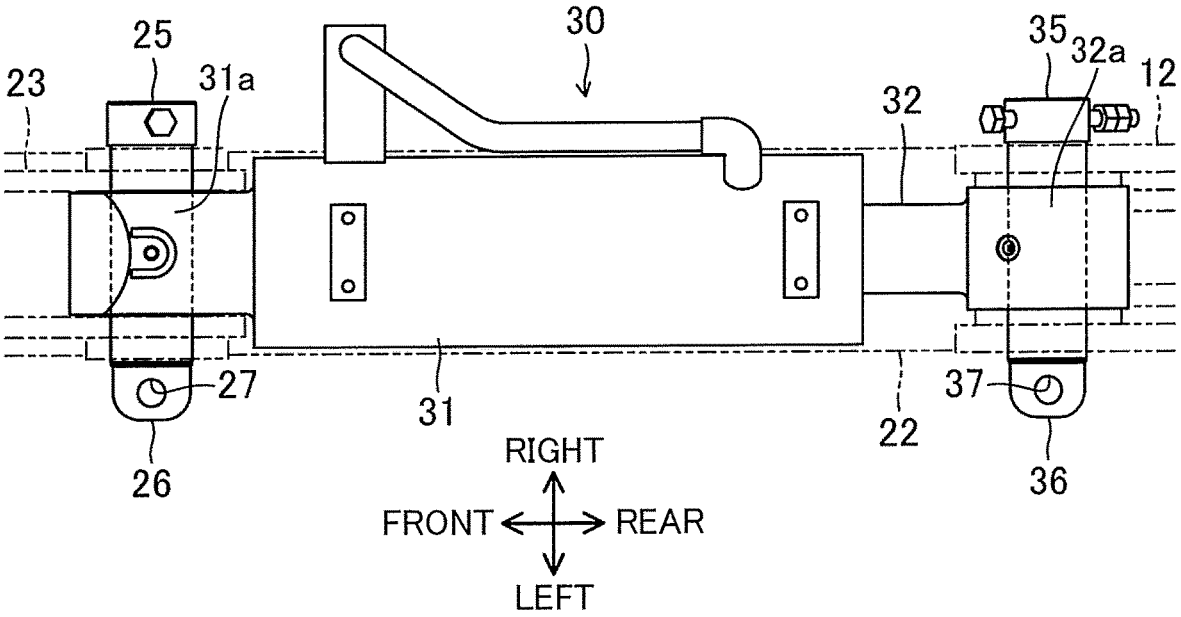
FIG. 4 is a plan view showing the dozer cylinder, first and second cylinder pins connected to the dozer cylinder, and first and second connection members joined with the first and second cylinder pins, respectively.

As shown in FIGS. 2 and 3, the lower travelling body 10 includes a lower frame 11, a pair of crawler frames 15 disposed at right and left sides of the lower frame 11, respectively, and a pair of track shoes 16 disposed around the crawler frames 15, respectively.

The lower frame 11 includes a pair of dozer support members 12. The pair of dozer support members 12 are disposed in a front portion of the lower frame 11 so as to be arranged in a right and left direction of the lower travelling body 10. Each dozer support member 12 includes a pair of vertical plates 12*a* arranged in the right and left direction and a dozer pin 13 extending in the right and left direction across the pair of vertical plates 12*a*, the dozer support member 12 supporting the dozer 20 so as to allow the dozer 20 to make vertically rotational movement about the dozer pin 13.

The dozer 20 includes a blade 21 and a pair of dozer arms 22.

The blade 21 is the body of the dozer 20, disposed on the front side of the lower travelling body 10. The blade 21 has a shape capable of soil removal, ground leveling, and the like.

The paired dozer arms 22 are spaced in the right and left direction. Each dozer arm 22 has a distal end connected to the blade 21 and an proximal end opposite thereto. Respective proximal ends are supported by the pair of dozer support members 12 so as to be capable of rotational movement about the dozer pin 13.

The dozer arm 22 includes an arm body, and a cylinder connection member 23 disposed on an upper surface of the arm body. The cylinder connection member 23 includes a pair of vertical plates 23*a* spaced in the right and left direction, being connected to the dozer cylinder 30 through the first cylinder pin 25. Each dozer support member 12 is connected to the dozer 20 through the second cylinder pin 35.

The paired dozer cylinders 30 are arranged in the right and left direction. Each dozer cylinder 30 includes a cylinder tube 31 and a piston rod 32. The piston rod 32 are protruded from and retracted into the cylinder tube 31 in the cylinder axis direction by supply and discharge of hydraulic fluid to and from the cylinder tube 31, thereby expanding and contracting the entire dozer cylinder 30 in the cylinder axis direction.

The cylinder tube 31 has a front end, which forms a tube end 31*a*, and a rear end opposite thereto. The tube end 31*a* serves as a cylinder front end, which is one of the opposite ends of the dozer cylinder 30 and connected to the dozer 20. The dozer cylinder 30 is disposed between the dozer 20 and the dozer support member 12 in such an attitude that the piston rod 32 extends rearward from the rear end of the cylinder tube 31, that is, such an attitude that the tube end 31*a* faces forward.

The tube end 31*a* is connected to the cylinder connection member 23 of the dozer arm 22 through the first cylinder pin 25 so as to be capable of rotational movement about the first cylinder pin 25. Thus, the cylinder tube 31 according to the present embodiment corresponds to the first cylinder element of the present invention.

The first cylinder pin 25 penetrates the pair of vertical plates 23*a* and the tube end 31*a* in the right and left direction, the tube end 31*a* being disposed between the pair of vertical plates 23*a* constituting the cylinder connection member 23. The first cylinder pin 25 allows the tube end 31*a* to make rotational movement relative to the first cylinder pin 25 about the first cylinder pin 25 while the opposite ends of the first cylinder pin 25 are fixed to the pair of vertical plates 23*a*. Alternatively, it is also acceptable that the opposite ends of the first cylinder pin 25 are supported by the pair of vertical plates 23*a* while a middle portion of the first cylinder pin 25 is fixed to the tube end 31*a*.

The piston rod 32 has a rear end, namely, a rod end 32*a*, which serves as a cylinder rear end that is one of the opposite ends of the dozer cylinder 30 and connected to the dozer support member 12 of the lower frame 11. The rod end 32*a* is connected to the dozer support member 12 through the second cylinder pin 35 so as to be capable of rotational movement about the second cylinder pin 35. Thus, the piston rod 32 according to the present embodiment corresponds to the second element of the present invention.

The second cylinder pin 35 penetrates the upper ends of the pair of vertical plates 12*a* and the rod end 32*a* in the right and left direction at a position above the dozer pin 13, the rod end 32*a* being disposed between respective upper ends of the pair of vertical plates 12*a* constituting the dozer support member 12. The second cylinder pin 35 allows the rod end 32*a* to make rotational movement relative to the second cylinder pin 35 about the second cylinder pin 35 while the opposite ends of the second cylinder pin 35 are fixed to the pair of vertical plates 12*a*. Alternatively, it is also acceptable that the opposite ends of the second cylinder pin 35 are supported by the pair of vertical plates 12*a* so as to be capable of rotational movement while a middle portion of the second cylinder pin 35 is fixed to the rod end 32*a*.

The thus disposed dozer cylinders 30 is able to cause the dozer arms 22 to make upward rotational movement about the respective dozer pins 13, through respective contractions of the dozer cylinders 30 in the cylinder axis direction, specifically, through respective retractions of the pistons rods 32 into the cylinder tubes 31, upon supply of hydraulic fluid, thereby bringing the dozer 20 into an upper position indicated by the solid line shown in FIG. 2. In contrast, the dozer cylinders 30 is able to cause the dozer arms 22 to make downward rotational movement about the respective dozer pins 13 through respective expansions of the dozer cylinders 30 in the axis direction, specifically through respective protrusions of the piston rods 32 from the cylinder tubes 31, upon supply of hydraulic fluid, thereby bringing the dozer 20 into a lower position indicated by the two-dot chain line shown in FIG. 2.

Respective orientations of the dozer cylinders 30 may be reversed with respect to the front-rear direction of the construction machine 1. Specifically, it is also possible that the tube end 31*a* is connected to the dozer support member 12 through the second cylinder pin 35 to serve as the second cylinder element while the rod end 32*a* is connected to the cylinder connection member 23 of the dozer arm 22 through the first cylinder pin 25 to serve as the first cylinder element. Furthermore, the present invention also encompasses another embodiment involving a single dozer cylinder which is disposed at a middle portion with respect to a right and left direction of a lower travelling body.

The first connection member 26 is joined with one end of the opposite ends of the first cylinder pin 25 in an axis direction of the first cylinder pin 25, namely, a first pin axis direction, the one end being an outer end of the first cylinder pin 25 with respect to the right and left direction in the present embodiment, so as to protrude outward from the one end in the first pin axis direction. Specifically, the first connection member 26 is a plate-shaped body protruding outward beyond the outer one of the pair of vertical plates 12*a* of the dozer support member 12 with respect to the right and left direction, i.e., the width direction of the upper slewing body 2.

The first connection member 26 has an inner peripheral surface defining a first through-hole 27. The first through-hole 27 passes through the first connection member 26 in a first penetration direction. The first penetration direction is a direction intersecting the cylinder axis direction and preferably also intersecting the first pin axis direction. The first penetration direction according to the present embodiment is a direction perpendicularly intersecting both the cylinder axis direction and the first pin axis direction, namely, a substantially up-down direction.

The second connection member 36 is joined with one end of the opposite ends of the second cylinder pin 35 on the same side as the one end of the first connection member 26 with respect to an axis direction of the second cylinder pin 35, namely, a second pin axis direction, so as to protrude outward from the one end in the second pin axis direction, the one end being an outer end of the second cylinder pin 35 in the right and left direction in the present embodiment Specifically, the second connection member 36 is a plate-shaped body protruding outward beyond the outer one of the pair of vertical plates 23*a* of the cylinder connection member 23 with respect to the right and left direction, namely, the width direction of the upper slewing body 2.

The second connection member 36 has an inner peripheral surface defining a second through-hole 37. The second through-hole 37 passes through the second connection member 36 in a second penetration direction. The second penetration direction is a direction intersecting the cylinder axis direction and preferably also intersecting the second pin axis direction. The second penetration direction according to the present embodiment is a direction perpendicularly intersecting both the cylinder axis direction and the second pin axis direction, i.e. a substantially up-down direction.

Figure 6:
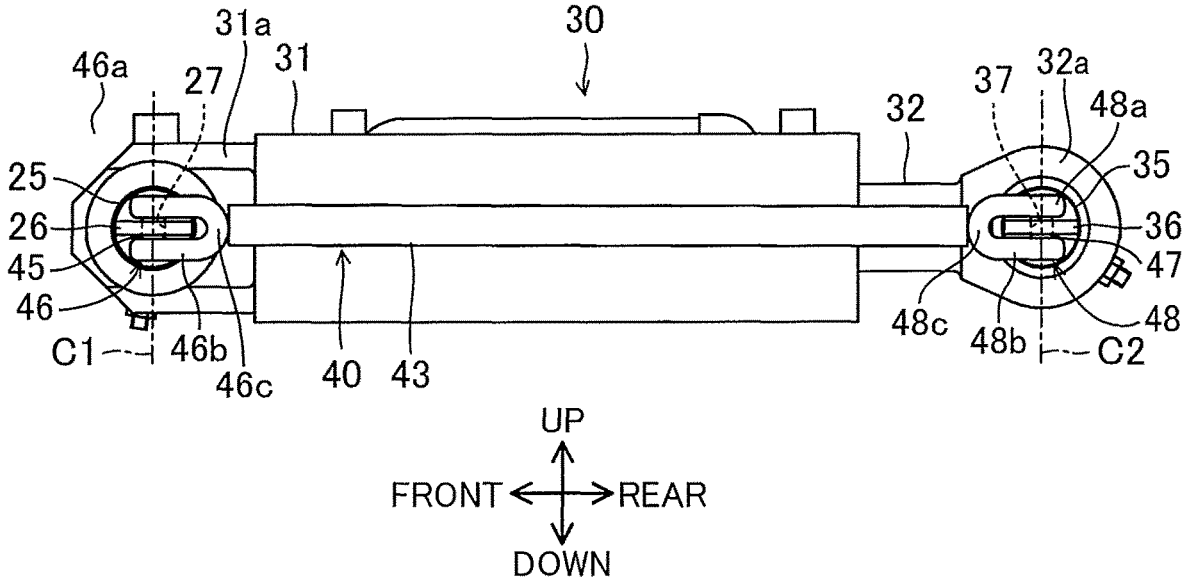
FIG. 6 is a side view of FIG. 5.

The first and second penetration directions are set to be parallel to each other at least when the dozer 20 is in the upper position. In other words, the central axis C1 of the first through-hole 27 and the central axis C2 of the second through-hole 37 shown in FIG. 6 are set to be substantially parallel to each other when the dozer 20 is in the upper position. As mentioned above, each of the first and second penetration directions according to the present embodiment is a direction perpendicular to the axis direction of the first cylinder pin 25 and perpendicular to the axis direction of the dozer cylinder 30, namely, a cylinder expansion and contraction direction (substantially vertical).

Each of the fixing members 40 is detachably connected to the first connection member 26 and the second connection member 36, when the dozer 20 is in the upper position, to interconnect the first and second connection members 26 and 36, thereby fixing the distance between the first cylinder pin 25 and the second cylinder pin 35, namely, the length of the dozer cylinder 30. This makes it possible to hold the dozer 20 in the upper position, independently of the dozer cylinders 30. The reason for the use of the fixing members 40 is as follows.

Figure 8:
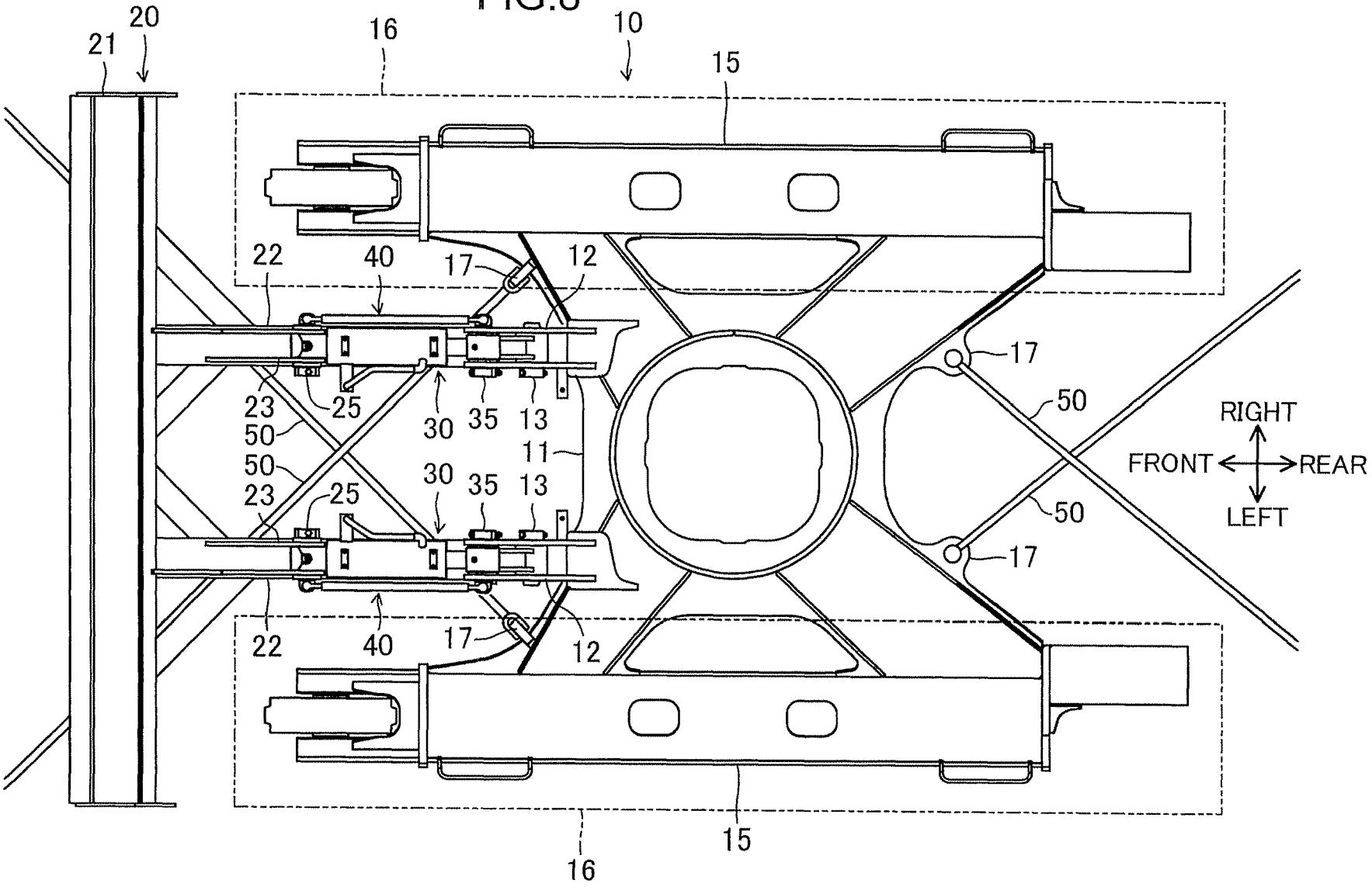
FIG. 8 is a plan view showing a lower frame of the construction machine and wire ropes connected to the lower frame for fixing the lower frame.
Figure 9:
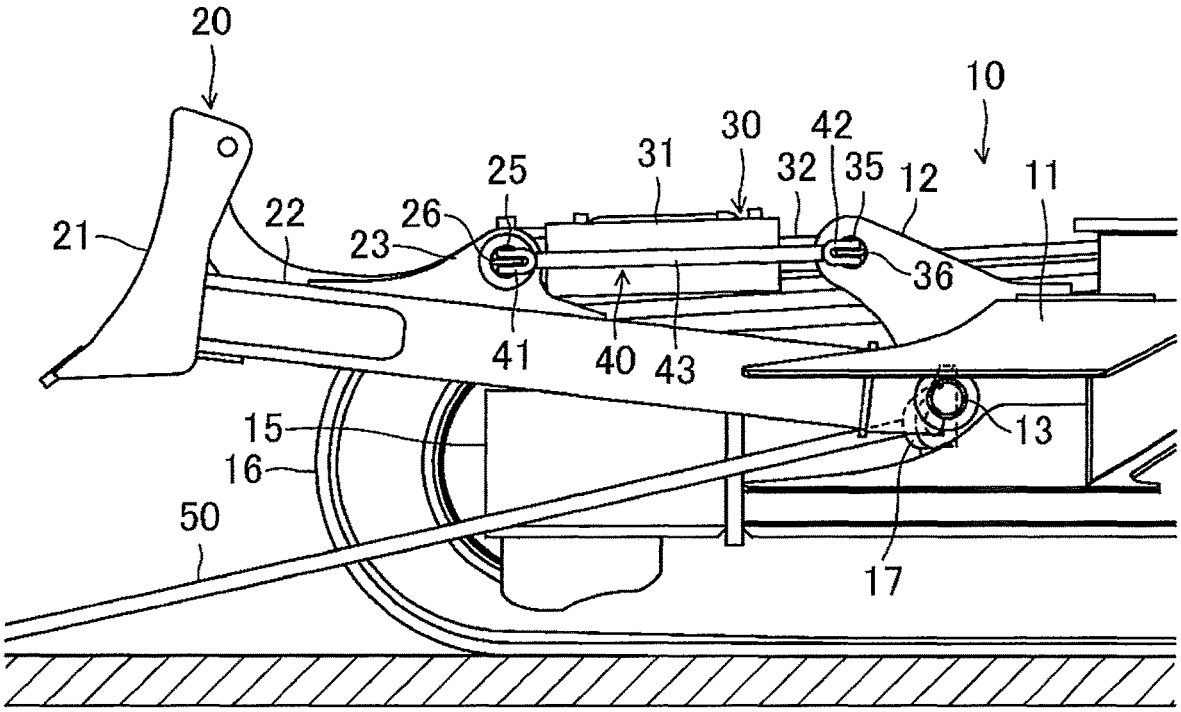
FIG. 9 is a side view showing the dozer held in an upper position and the wire ropes routed under the dozer.
Figure 9:
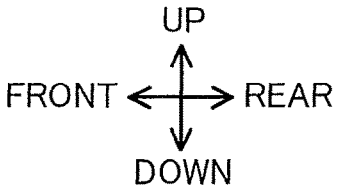

In order to transport the construction machine 1 on a loading platform of, for example, a truck or a trailer, it is necessary to secure the construction machine 1 to the loading platform with a plurality of wire ropes 50 as shown in FIG. 8. Furthermore, in order to prevent the construction machine 1 from lateral displacement during the transportation, the wire ropes 50 is preferably tightened with their intersections to each other between the right and left crawler frames 15.

On the other hand, the dozer 20 is required to be held in the upper position so as not to interfere with the tightening of the wire ropes 50. The upper position can be retained through block of supply and discharge of hydraulic fluid to and from the dozer cylinders 30 to fix respective lengths of the dozer cylinders 30 in the cylinder axis direction. However, if hydraulic fluid leaks from the dozer cylinders 30 during the transportation of the construction machine 1, the dozer cylinders 30 will be gradually expanded by an extent corresponding to the leakage. This will hinders the dozer 20 from being held in the upper position.

The fixing members 40 are provided to mechanically fix respective lengths of the dozer cylinders 30 independently of block of the flow of hydraulic fluid to and from the dozer cylinders 30, restraining the dozer 20 from downward rotational movement from the upper position to come into contact with the wire ropes 50.

Figure 5:
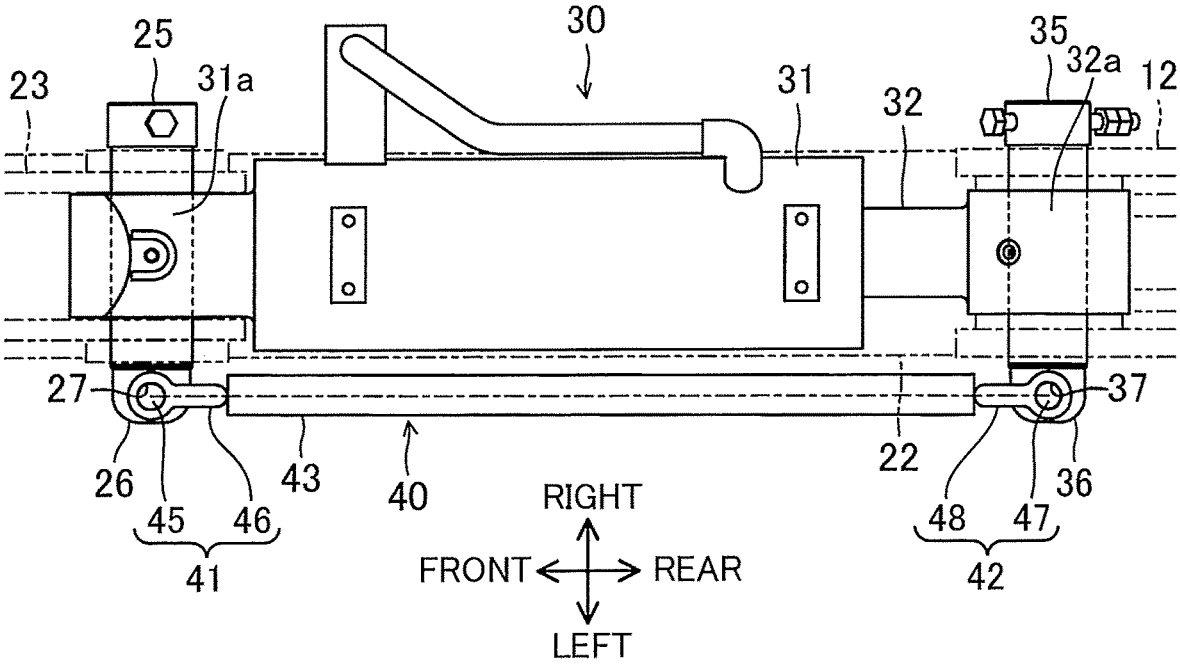
FIG. 5 is a plan view showing the first and second connection members interconnected through a fixing member.
Figure 7:
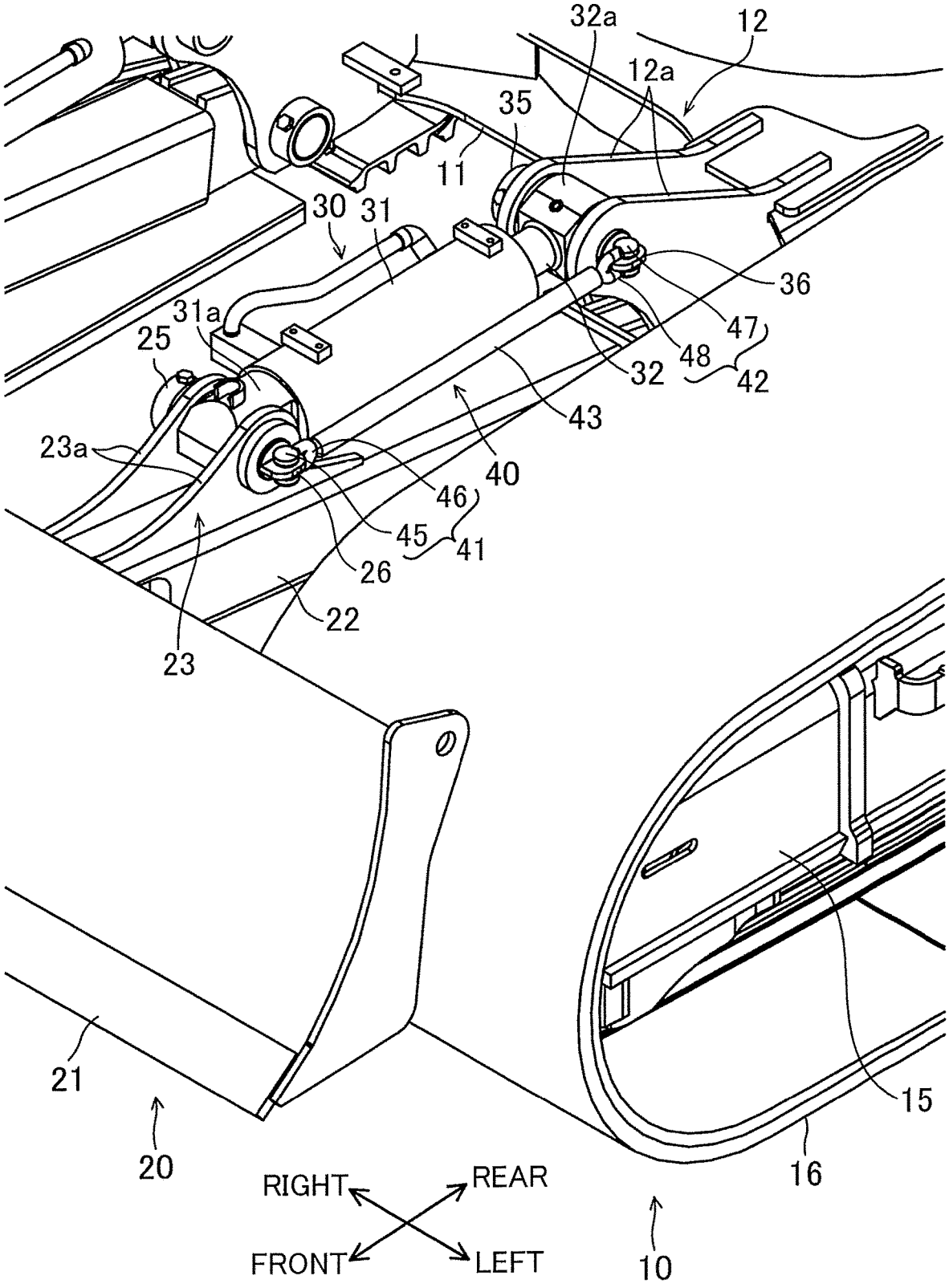
FIG. 7 is a perspective view of FIG. 5.

Specifically, in order to mechanically interconnect the first connection member 26 and the second connection member 36 to thereby fix the dozer 20 in the upper position as shown in FIGS. 5 to 7, each of the fixing members 40 has a shape extending in the direction of the interconnection, that is, the cylinder axis direction in the present embodiment.

The fixing member 40 includes a first engagement section 41, a second engagement section 42, and an interconnection section 43. The first engagement section 41 and the second engagement section 42 form longitudinally opposite ends of the fixing member 40, respectively. The first engagement section 41 is configured to be detachably connected to the first connection member 26 through engagement with the first connection member 26 involving the first through-hole 27. The second engagement section 42 is configured to be detachably connected to the second connection member 36 through engagement with the second connection member 36 involving the second through-hole 37.

The first engagement section 41 includes a first insertion part 45 and a first support part 46.

The first insertion part 45 is able to be supported by the first support part 46 while being inserted into the first through-hole 27 to penetrate the first connection member 26. The first engagement section 41 is engaged with the first connection member 26 involving the insertion of the first insertion part 45.

The first support part 46 includes a pair of support portions 46*a*, 46*b* and a connection portion 46*c* that are integrated with each other. The paired support portions 46*a* and 46*b* can be disposed on both sides of the first connection member 26 in the first penetration direction, respectively, each having a through-hole able to match the first through-hole 27. The connection portion 46*c* interconnects respective portions of the support portions 46*a* and 46*b* that are on the side closer to the interconnection section 43, and connects these portions to the interconnection section 43. The first support part 46 can be formed of, for example, a U-shaped metal member as shown in FIG. 6.

The first insertion part 45 is inserted into the through-holes of the pair of support portions 46*a* and 46*b* and the first through-hole 27 to thereby detachably join the pair of support portions 46*a* and 46*b* with the first connection member 26. The first insertion part 45 is, for example, a pin with a head part. In the case of such a pin, a retaining member is attached to the end of the pin opposite to the head part. The first insertion part 45 may be, alternately, a bolt, which is retainable by being screwed into a female thread formed in the through-hole of either one of the pair of support portions 46*a* and 46*b* or through a nut screwed on the bolt.

The second engagement section 42 includes a second insertion part 47 and a second support part 48.

The second insertion part 47 is able to be supported by the second support part 48 while being inserted into the second through-hole 37 to penetrate the second connection member 36. The second engagement section 42 is engaged with the second connection member 36 involving the insertion of the second insertion part 47.

The second support part 48 includes a pair of support portions 48*a*, 48*b* and a connection portion 48*c* that are integrated with each other. The paired support portions 48*a* and 48*b* can be disposed on both sides of the second connection member 36 in the second penetration direction, respectively, each having a through-hole able to match the second through-hole 37. The connection portion 48*c* interconnects respective portions of the support portions 48*a* and 48*b* that are on the side closer to the interconnection section 43, and connects these portions to the interconnection section 43. The second support part 48 can be formed of, for example, a U-shaped metal member as shown in FIG. 6.

The second insertion part 47 is inserted into the through-holes of the pair of support portions 48*a* and 48*b* and the second through-hole 37 to thereby detachably join the pair of support portions 48*a* and 48*b* with the second connection member 36. The second insertion part 47 is, for example, a pin with a head part. In the case of such a pin, a retaining member is attached to the end of the pin opposite to the head part. The second insertion part 47 may be, alternately, a bolt, which is retainable by being screwed into a female thread formed in the through-hole of either one of the pair of support portions 48*a* and 48*b* or through a nut screwed on the bolt.

The interconnection section 43 extends longitudinally to interconnect the first engagement section 41 and the second engagement section 42. The interconnection section 43 has a length that brings the distance between the first engagement section 41 and the second engagement section 42 into coincidence with the distance between the first cylinder pin 25 and the second cylinder pin 35 when the dozer 20 is in the upper position. The interconnection section 43 is, for example, formed of a chain block having the above-mentioned length.

The dozer 20 is held in the upper position through respective retractions of the dozer cylinders 30, i.e. respective retractions of the piston rods 32 into the cylinder tubes 31 of the respective dozer cylinders 30. The connection of the first and second engagement sections 41 and 42 of each fixing member 40 to the first and second connection members 26 and 36 when the dozer 20 is in the upper position enables the distance between the first cylinder pin 25 and the second cylinder pin 35 that are joined with the first and second connection members 26 and 36, respectively, to be mechanically fixed, independently of the dozer cylinder 30. This makes it possible to prevent the dozer 20 from undesirable downward rotational movement from the upper position, regardless of leakage of hydraulic fluid from the dozer cylinders 30. This hinders the dozer 20 from coming into contact with the wire ropes 50, thereby restraining the dozer 20 and the wire ropes 50 from breaking.

In the upper position of the dozer 20, the first penetration direction of the first through-hole 27 and the second penetration direction of the second through-hole 37 are parallel to each other, which allows the first insertion part 45 of the first engagement section 41 to come into surface contact with the inner peripheral surface of the first connection member 26 defining the first through-hole 27 and allows the second insertion part 47 of the second engagement section 42 to come into surface contact with the inner peripheral surface of the second connection member 36 defining the second through-hole 37. This allows respective loads on the fixing member 40, the first connection member 26, and the second connection member 36 to be distributed.

It should be understood that the expression "the second penetration direction parallel to the first penetration direction" used in the present invention is not intended to require that the second penetration direction be geometrically completely parallel to the first penetration direction; the first penetration direction and the second penetration direction only have to be substantially parallel to each other enough to distribute the load.

The fixing members 40 are preferably stored, for example, in a not-graphically-shown tool box of the construction machine 1. The thus stored fixing members 40 can be taken out of the box immediately at a work site.

In the state of the dozer 20 thus fixed in the upper position through the fixing members 40, the work is performed to tension the wire ropes 50 around the lower frame 11 of the lower travelling body 10. Specifically, each of a front portion and a rear portion of the lower frame 11 is provided with a pair of right and left wire attaching members 17, each wire attaching member 17 being engageable with one end of a wire rope 50, as shown in FIG. 8. A pair of wire ropes 50 engaged with the front pair of wire attaching members 17 are routed while intersecting each other, between the right and left crawler frames 15 and under the dozer 20 in the upper position. A pair of wire ropes 50 engaged with the rear pair of the wire attaching members 17 are routed while intersecting each other between the right and left crawler frames 15 and the respective other ends of the pair of wire ropes 50 are fastened to a loading platform of a trailer or the like. The construction machine 1 is thereby fixed to the loading platform.

Figure 10:
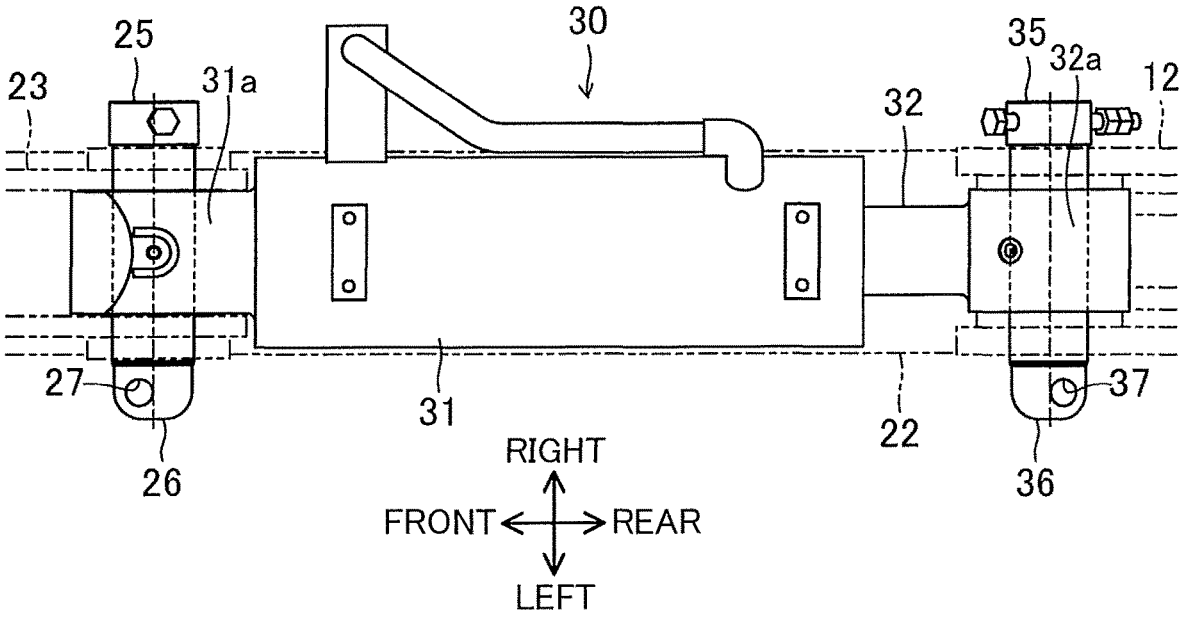
FIG. 10 is a plan view showing a dozer cylinder, first and second cylinder pins, and first and second connection members according to a modification of the embodiment.

FIG. 10 shows a first connection member 26 and a second connection member 36 according to a modification of the above-described embodiment.

Similarly to the first connection member 26 according to the above-described embodiment shown in FIGS. 1 to 9, the first connection member 26 is joined with an end of the first cylinder pin 25 and formed with a first through-hole 27; however, the first through-hole 27 is formed in the first connection member 26 at a position offset forward from the central axis of the first cylinder pin 25, that is, a position offset outward from the central axis of the first cylinder pin 25 in the cylinder axis direction.

Similarly, although the second connection member 36 is joined with an end of the second cylinder pin 35 and formed with a second through-hole 37, the second through-hole 37 is formed in the second connection member 36 at a position offset rearward from the central axis of the second cylinder pin 35, that is, a position offset outward from the central axis of the second cylinder pin 35 in the cylinder axis direction.

Respective offsets of the first through-hole 27 and second through-hole 37 from the respective cylinder central axes in the front-rear direction (cylinder axis direction) increases the length of the portion of the first connection member 26 extending rearward of the lower travelling body beyond the first through-hole 27 and the length of the portion of the second connection member 36 extending frontward of the lower travelling body beyond the second through-hole 37, respectively. This allows respective load-receiving portions of the first connection member 26 and the second connection member 36 to have increased rigidity, each the road-receiving portion being a portion that receives a concentrated load from the fixing member 40 due to the contact with the fixing member 40.

The present invention is not limited to the above-described embodiment and modification. The present invention encompasses, for example, the following embodiments.

Although the above-described embodiment discloses the first cylinder pin 25 and the first connection member 26 that are integrally formed with each other and the second cylinder pin 35 and the second connection member 36 are integrally formed with each other, the first cylinder pin and the first connection member according to the present invention may be formed as separate members and, similarly, the second cylinder pin and the second connection member according to the present invention may be formed as separate members. For example, the first connection member 26 may be formed of a member independent of the first cylinder pin 25 and having a U-shaped cross section, that is, a member opened to one side, the opened end of the first connection member 26 having the U-shaped cross section being butt and welded to an end of the first cylinder pin 25. In this case, the first through-hole is defined by the end of the first cylinder pin 25 and the first connection member 26. The same applies to the second cylinder pin 35 and the second connection member 36.

Alternatively, the first connection member 26 may be formed of a member independent of the first cylinder pin 25 and having a T-shaped cross section that includes a flange portion to be butt and bolted to an end of the first cylinder pin 25. The same applies to the second cylinder pin 35 and the second connection member 36.

As described above, there is provided a construction machine capable of reliably holding a dozer in an upper position. The construction machine comprises: a lower travelling body including a lower frame; a dozer capable of vertically rotational movement relative to the lower frame; at least one dozer cylinder including a cylinder tube and a piston rod capable of protruding from and retracting into the cylinder tube to bring the dozer cylinder into expansion and contraction in a cylinder axis direction, the dozer cylinder being connected to the dozer so as to bring the dozer into vertically rotational movement, through the expansion and contraction of the dozer cylinder, between an upper position and a lower position; a first cylinder pin movable integrally with a first cylinder element, which is one of the cylinder tube and the piston rod, while connecting the first cylinder element to the dozer so as to allow the first cylinder element to make rotational movement relative to the dozer; a second cylinder pin movable integrally with a second cylinder element, which is the other of the cylinder tube and the piston rod, while connecting the second cylinder element to the lower frame so as to allow the second cylinder element to make rotational movement relative to the lower frame; a first connection member joined with an end of the first cylinder pin and defining a first through-hole passing through the first connection member in a first penetration direction intersecting (preferably, perpendicularly intersecting) the cylinder axis direction; a second connection member joined with an end of the second cylinder pin and defining a second through-hole passing through the second connection member in a second penetration direction that is parallel to the first penetration direction of the first through-hole when the dozer is in the upper position; and a fixing member for interconnecting the first connection member and the second connection member to fix the dozer in the upper position. The fixing member includes a first engagement section having a first insertion part and a first support part for supporting the first insertion part, the first engagement section being capable of first engagement with the first connection member, the first engagement involving insertion of the first insertion part into the first through-hole, to be thereby detachably connected to the first connection member, a second engagement section having a second insertion part and a second support part for supporting the second insertion part, the second engagement section being capable of second engagement with the second connection member, the second engagement involving insertion of the second insertion part into the second through-hole, to be thereby detachably connected to the second connection member, and an interconnection section interconnecting the first engagement section and the second engagement section.

In this construction machine, using the fixing member to interconnect the first connection member joined with the end of the first cylinder pin and the second connection member joined with the end of the second cylinder pin makes it possible to mechanically fix the distance between the first cylinder pin and the second cylinder pin to prevent the dozer from rotational movement, which enables the dozer to be held in the upper position, independently of the dozer cylinder. This prevents the dozer from being undesirably lowered from the upper position to thus come into contact with wire ropes routed under the dozer.

Besides, the parallelism of the first penetration direction and the second penetration direction when the dozer is in the upper position allows the first engagement section and the second engagement section to come into respective surface contacts with the first connection member defining the first through-hole and the second connection member defining the second through-hole. This allows respective loads on the fixing member, the first connection member, and the second connection member to be distributed.

It is preferable that the first connection member protrudes from an axial end of the first cylinder pin in an axis direction of the first cylinder pin and the second connection member protrudes from an axial end of the second cylinder pin in an axis direction of the second cylinder pin, and that the first penetration direction intersects (preferably, perpendicularly intersects) the axis direction of the first cylinder pin and the second penetration direction intersects (preferably, perpendicularly intersects) the axis direction of the second cylinder pin. These make it possible to compactly dispose the first and second connection members with effective utilization of spaces outside the first and second cylinder pins in the axis direction and to establish the first and second engagements of the first and second connection members with the first and second engagement sections of the fixing member involving the first and second through holes of the first and second connection members.

In the above-described configuration, it is more preferable that the first through-hole is formed in the first connection member at a position offset outward from a central axis of the first cylinder pin in the cylinder axis direction, and the second through-hole is formed in the second connection member at a position offset outward from a central axis of the second cylinder pin in the cylinder axis direction.

This allows respective portions of the first connection member and the second connection member that require substantial rigidity to have enhanced rigidities. Specifically, although each of portions of the first connection member located on inner side of the first through-hole in the cylinder axis direction and a portion of the second connection member located on inner side of the second through-hole in the cylinder axis direction receives a concentrated load from the fixing member, the above-described respective offsets of the first through-hole and the second through-hole allow the respective portions of the first connection member and the second connection member to have the increased lengths to possess their ensured rigidities.

It is preferable that each of the first cylinder pin and the second cylinder pin is disposed to extend in a direction parallel to a right and left direction of the lower travelling body, and the first connection member is joined with one end of opposite ends of the first cylinder pin in the right and left direction and the second connection member is joined with one end of opposite ends of the second cylinder pin on the same side as the one end of the first connection member in the right and left direction. This allows the required length of the fixing member to be small.

It is preferable that the at least one dozer cylinder includes a pair of dozer cylinders arranged in the right and left direction of the lower travelling body, and the first connection member and the second connection member are joined with respective outer ends of the opposite ends of the first cylinder pin and the second cylinder pin that are connected to the pair of dozer cylinders, each of the outer ends being an end located on an outer side in the right and left direction of the lower travelling body. This allows respective works of connecting the first engagement section and the second engagement section of the fixing member to the first connection member and the second connection member to be conducted easily outside the lower travelling body in the right and left direction.

This application is based on Japanese Patent application No. 2019-029631 filed in Japan Patent Office on Feb. 21, 2019, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine, comprising:

a lower travelling body including a lower frame;

a dozer attached to the lower travelling body so as to be capable of vertically rotational movement relative to the lower frame;

at least one dozer cylinder including a cylinder tube and a piston rod capable of protruding from and retracting into the cylinder tube to bring the dozer cylinder into expansion and contraction in a cylinder axis direction, the dozer cylinder being connected to the dozer and the lower frame so as to bring the dozer into vertically rotational movement relative to the lower frame, through the expansion and contraction of the dozer cylinder, between an upper position and a lower position;

a first cylinder pin movable integrally with a first cylinder element, which is one of the cylinder tube and the piston rod, while connecting the first cylinder element to the dozer so as to allow the first cylinder element to make rotational movement relative to the dozer;

a second cylinder pin movable integrally with a second cylinder element, which is the other of the cylinder tube and the piston rod, while connecting the second cylinder element to the lower frame so as to allow the second cylinder element to make rotational movement relative to the lower frame;

a first connection member joined with an end of the first cylinder pin and defining a first through-hole passing through the first connection member in a first penetration direction intersecting the cylinder axis direction;

a second connection member joined with an end of the second cylinder pin and defining a second through-hole passing through the second connection member in a second penetration direction that is parallel to the first penetration direction of the first through-hole when the dozer is in the upper position; and a fixing member that is a member separate from the dozer and the lower frame to which the dozer cylinder is connected, the fixing member being detachably connectable to the first connection member and the second connection member separately from the dozer and the lower frame to interconnect the first connection member and the second connection member so as to fix a distance between the first cylinder pin and the second cylinder pin independently of the dozer cylinder to fix the dozer in the upper position, wherein the fixing member includes: a first engagement section having a first insertion part and a first support part for supporting the first insertion part, the first engagement section being capable of first engagement with the first connection member, the first engagement involving insertion of the first insertion part into the first through-hole, to be thereby detachably connected to the first connection member; a second engagement section having a second insertion part and a second support part for supporting the second insertion part, the second engagement section being capable of second engagement with the second connection member, the second engagement involving insertion of the second insertion part into the second through-hole, to be thereby detachably connected to the second connection member; and an interconnection section interconnecting the first engagement section and the second engagement section separately from the dozer and the lower frame to prevent the dozer from downward rotational movement relative to the lower frame from the upper position when the first engagement section is connected to the first connection member and the second engagement section is connected to the second connection member.

2. The construction machine according to claim 1, wherein the first connection member protrudes from an axial end of the first cylinder pin in an axis direction of the first cylinder pin and the second connection member protrudes from an axial end of the second cylinder pin in an axis direction of the second cylinder pin, the first penetration direction intersecting the axis direction of the first cylinder pin, the second penetration direction intersecting the axis direction of the second cylinder pin.

3. The construction machine according to claim 2, wherein the first through-hole is formed in the first connection member at a position offset outward from a central axis of the first cylinder pin in the cylinder axis direction, and the second through-hole is formed in the second connection member at a position offset outward from a central axis of the second cylinder pin in the cylinder axis direction.

4. The construction machine according to claim 2, wherein: each of the first cylinder pin and the second cylinder pin is disposed to extend in a direction parallel to a right and left direction of the lower travelling body; the first connection member is joined with one end of opposite ends of the first cylinder pin in the right and left direction; and the second connection member is joined with one end of opposite ends of the second cylinder pin on the same side as the one end of the first connection member in the right and left direction.

5. The construction machine according to claim 4, wherein: the at least one dozer cylinder includes a pair of dozer cylinders arranged in the right and left direction of the lower travelling body; the first connection member and the second connection member are joined with respective outer ends of the opposite ends of the first cylinder pin and the second cylinder pin that are connected to the pair of dozer cylinders, each of the outer ends being an end located on an outer side in the right and left direction of the lower travelling body.

6. The construction machine according to claim 1, wherein the first insertion part is a first pin that is inserted into the first through-hole, and the second insertion part is a second pin that is inserted into the second through-hole.

7. The construction machine according to claim 1, wherein the first insertion part is a first bolt that is screwed into a female thread foil led in the first through-hole or through a first nut screwed on the first bolt, and the second insertion part is a second bolt that is screwed into a female thread formed in the second through-hole or through a second nut screwed on the second bolt.

* * * * *